US005609512A

United States Patent [19]

Holmes et al.

[11] Patent Number: 5,609,512

[45] Date of Patent: Mar. 11, 1997

[54] METHOD AND APPARATUS FOR OFF-LINE HONING OF SLICER BLADES

[75] Inventors: Terry L. Holmes, DeForest; Gary R. Skaar, Marshall; Larry C. Gundlach, Madison; Dennis G. Flisram, Plainfield, all of Wis.

[73] Assignee: Kraft Foods, Inc., Northfield, Ill.

[21] Appl. No.: 370,722

[22] Filed: Jan. 9, 1995

[51] Int. Cl.[6] ..... B24B 1/00; B24B 3/12; B24B 9/04; B24B 49/06

[52] U.S. Cl. ..... 451/48; 451/23; 451/44; 451/210; 451/239; 451/246; 451/263; 451/269

[58] Field of Search ..... 451/267–269, 451/263, 13, 23, 360, 361, 45, 65, 9, 239, 281, 24, 44, 237, 242, 246, 207, 210, 43, 48

[56] References Cited

U.S. PATENT DOCUMENTS

| | | | |
|---|---|---|---|
| 700,293 | 5/1902 | Becker . | |
| 1,522,109 | 1/1925 | Fiddyment . | |
| 2,978,848 | 4/1961 | Raine . | |
| 3,641,711 | 2/1972 | Halberschmidt et al. | 451/237 |
| 3,813,818 | 6/1974 | Hayashi | 451/237 |
| 3,820,289 | 6/1974 | Good . | |
| 4,040,313 | 8/1977 | Lustgraaf | 76/37 |
| 4,365,301 | 12/1982 | Arnold et al. | 364/475 |
| 4,406,091 | 9/1983 | Eckardt et al. | 451/239 |
| 4,672,777 | 6/1987 | Dunkin | 451/267 |
| 4,829,721 | 5/1989 | Wright . | |
| 4,976,070 | 12/1990 | Palazzola | 451/239 |
| 5,097,634 | 3/1992 | Hulme . | |
| 5,117,590 | 6/1992 | Kudo et al. | 451/239 |
| 5,142,947 | 9/1992 | Wang | 76/42 |
| 5,152,105 | 10/1992 | Belvederi . | |
| 5,320,014 | 6/1994 | Skaar et al. | 83/42 |
| 5,398,460 | 3/1995 | Joncour | 451/43 |

FOREIGN PATENT DOCUMENTS

| | | |
|---|---|---|
| 2620837 | 1/1978 | Germany . |
| 2238494 | 6/1991 | United Kingdom . |

*Primary Examiner*—Timothy V. Eley
*Attorney, Agent, or Firm*—Lockwood, Alex, Fitzgibbon & Cummings

[57] ABSTRACT

An apparatus and method for honing, sharpening or grinding a curved peripheral cutting surface of a slicer blade are provided. Included is the use of one of a set of interchangeable cams that generally follows the curved shape of the blade cutting surface, whether same has a constant radius or varying radii. In order to minimize downtime and sanitation operations, the honing is accomplished off-line of the slicer equipment. Preferably, the slicer blade remains perfectly flat during honing, and the movement of one or more honing or grinding wheels is closely controlled so as to provide honed or ground cutting edges which are of substantially uniform width throughout their respective peripheries. Honing is accomplished in accordance with objectively measured sharpness standards by which superior sharpness levels are attained.

19 Claims, 10 Drawing Sheets

METHOD AND APPARATUS FOR OFF-LINE HONING OF SLICER BLADES

BACKGROUND AND DESCRIPTION OF THE INVENTION

The present invention generally relates to honing of cutting devices by which components such as slicer blades are sharpened, honed or ground along their respective cutting edges. The invention is particularly well-suited for honing, grinding and/or sharpening blades for slicing food products such as large sticks, chubs, loaves or pieces of meat, luncheon meat, cheese and the like. These slicing blades typically have a curved cutting surface or edge portion along all or a substantial part of the periphery of the slicer blade. The invention includes use of a cam member that has a curved pathway at least a portion of which emulates the profile or peripheral shape of the slicing edge of the blade. One or more honing spindle assemblies, preferably two of them, are associated with cam followers which engage and follow the camming surface of the cam member. Rotating honing wheels of these honing spindle assemblies closely follow the peripheral edge portion of the blade to effect the honing action in a uniform and accurate manner. The invention also allows substantially simultaneous honing of generally oppositely facing ground surfaces to minimize the presence of burring on the finished, fully honed blade.

Slicing equipment for foods and the like are in use within the food processing industry and in other situations when elongated products need to be severed into thin slices. This is especially the case for food processing plants wherein finished products such as sliced luncheon meats, sliced bacon, sliced meat cuts, sliced cheese and the like are processed through a large industrial-scale slicer. In a typical operation, these slices are then packaged and distributed for retail sale as convenient ready-to-sell units. Commercial slicer equipment that is used for slicing and sometimes also stacking and weighing the slices are or have been available from well-known manufacturers such as Cashin, Anco, Formax, Great Lakes and Thurne. Each manufacturer generally uses a blade or blades of differing shape and/or sizing. The blades can have peripheral shapes which are circular, involute, spiral, and the like, each of which has a curved surface of constant radius or varying radii along the periphery of the cutting surface. Each blade is somewhat large and has substantial area that is at least nominally flat.

Some of this slicer equipment provide honing devices attached to the slicer itself. This approach is taken in order to afford an apparent advantage of achieving honing through an on-line approach which avoids the need to remove the large blade from the slicer in order to hone or sharpen it. However, this on-line approach has disadvantages which often outweigh this advantage. When honing or sharpening on-line, the resultant grinding dust or particles will often be deposited at locations which could find their way into the food product. Accordingly, it is essential to totally sanitize entire areas of the slicing equipment in addition to cleaning of the blade itself. Furthermore, the slicer, and in many cases a production line of which it is but one component, must be shut down during the entire course of the sharpening and clean-up operations.

The present invention avoids these disadvantages by providing a honing apparatus that is totally removed from the large slicing equipment. By this off-line approach, the slicing equipment and food processing line of which it may be a component need to be shut down for only the time that is required to remove the dull blade and replace it with another, previously sharpened or honed or ground blade. In addition, once thus installed, only this fresh blade needs to be treated for sanitary reasons, such as by simply squirting appropriate aqueous liquid onto the blade which had been thoroughly cleaned and sanitized and at a location remote from the food processing area to remove grinding particles and the like prior to mounting it onto the slicer equipment. This approach minimizes downtime and does not have the handling constraints which are characteristic of on-line devices.

Most slicer blades have ground cutting surfaces on both the top and the bottom edges of the peripheral cutting portion of the blade. Various honing or sharpening approaches in the past have proceeded with the honing of one ground edge at a time. This typically causes the formation of a burr on the other surface. Then, when the other surface is honed, a burr is formed on the first surface. This leads to alternative honing (after the first honing step) through burrs formed during honing of an opposite surface, typically leaving a burr on the cutting surface opposite of the last-honed surface.

Another difficulty which is often encountered in sharpening large blades such as the large slicer blades for commercial meat slicers is the difficulty in maintaining flatness of blades having such an extensive peripheral edge. In this regard, it is important that the blade be as flat as possible during honing, and when needed, accommodate blade body curvatures or cavities while maintaining a flat peripheral edge portion. If not, the honed ground surface typically will exhibit a non-uniform width along the peripheral extent of the cutting edge of the blade. Another challenge for off-line honers is having them arranged so as to be suitable for use with any one of the variety of differently sized and/or shaped blades that are required for the various slicers in commercial use. Each such blade has a curved periphery, but curve size and shape varies from blade to blade. This difficulty is particularly evident when a processing plant utilizes slicers of different manufacturers and/or of different sizes.

In summary, the present invention addresses each of these problems or difficulties by providing for off-line honing of slicer blades. The apparatus of the invention includes a cam member having a curved pathway or camming surface that is shaped to follow a curved cutting surface of a particular type of cutting blade. A variety of such cam members can be provided, each one of which being sized and shaped for a particular style and size of slicer blade. Various such blades and cam members are interchangeably mounted on a rotation assembly that rotates a properly sized and shaped cam member and its corresponding cutter blade together. During such rotation, a cam follower of a honing spindle assembly engages the cam member in order to thereby assist in directing a rotating honing wheel or the like along the blade surface to be honed, sharpened or ground. A suitable biasing assembly ensures contact is maintained between the cam follower and the cam member. In this way, the rotating honing wheel or the like closely follows the curvature of the particular blade being sharpened. In a preferred embodiment, at least two honing spindle assemblies are provided, and a top peripheral edge as a well as bottom peripheral edge of the slicer blade are honed substantially simultaneously in order to provide a finished honed blade that is deburred.

It is a general object of the present invention to provide for improved off-line honing of slicer blades.

Another object of this invention is to provide an improved off-line honing apparatus and method which reduces downtime and minimizes sanitization procedures associated with maintaining a sharp and properly honed blade on commercial slicers.

Another object of the present invention is to provide an improved off-line honing apparatus and method which avoids the need for total sanitation procedures associated with slicer blade sharpening.

Another object of this invention is to provide an improved honing apparatus and method which reduces down time for blade sharpening to the time required to exchange slicer blades on the slicing apparatus.

Another object of the present invention is to provide improved honing of slicer blades that minimizes the formation of burrs.

Another object of this invention is to provide an improved apparatus and method for attaining superior sharpness levels on large slicer blades.

Another object of the present invention is to provide an improved honing apparatus and method which maintains close tolerances with respect to blade flatness and particularly cutting edge flatness, while forming honed or ground cutting edge surfaces which are of substantially uniform width throughout their respective peripheral lengths.

These and other objects, features and advantages of the present invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
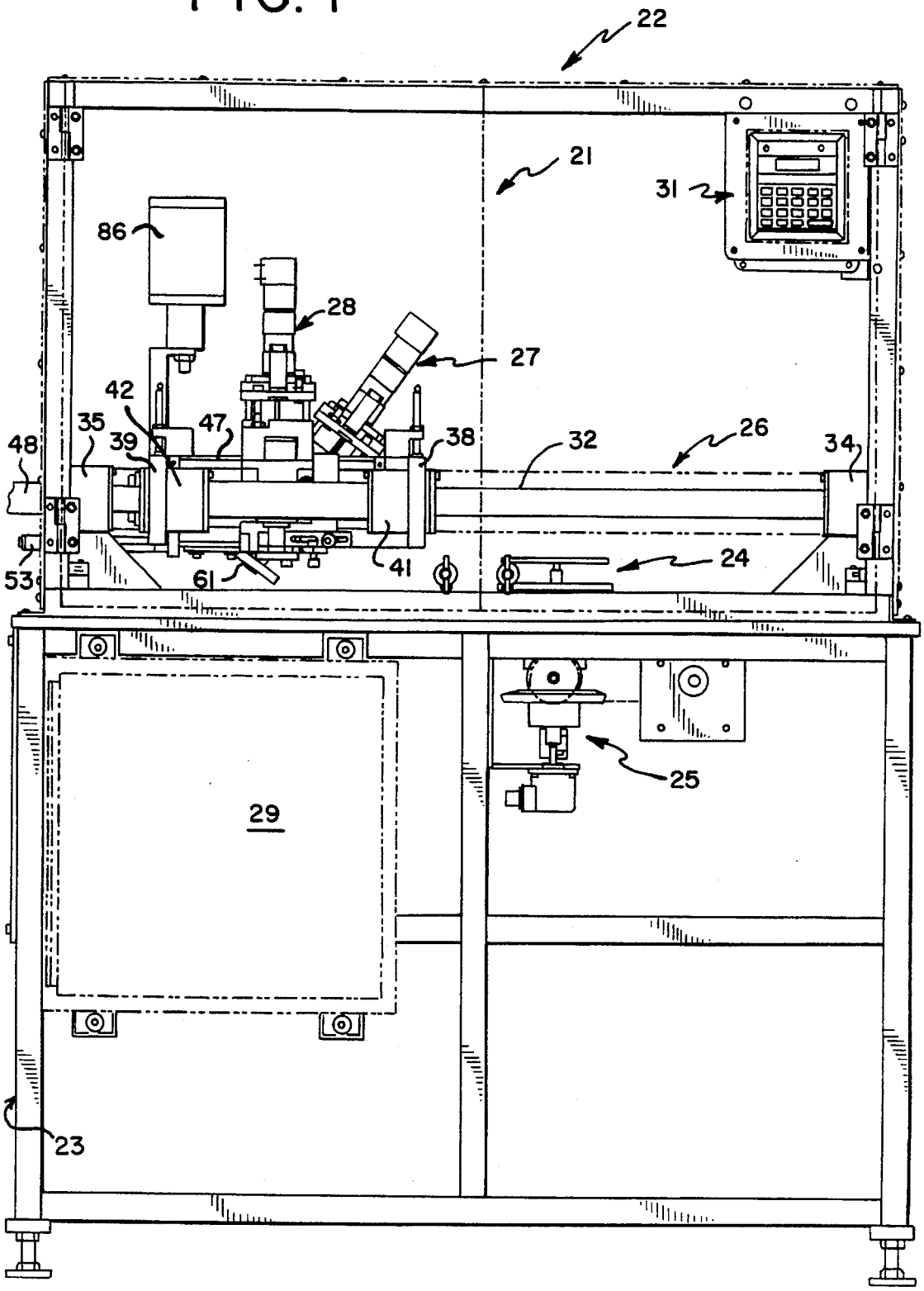
FIG. 1 is an elevational front view of a honing apparatus in accordance with the present invention.
Figure 2:
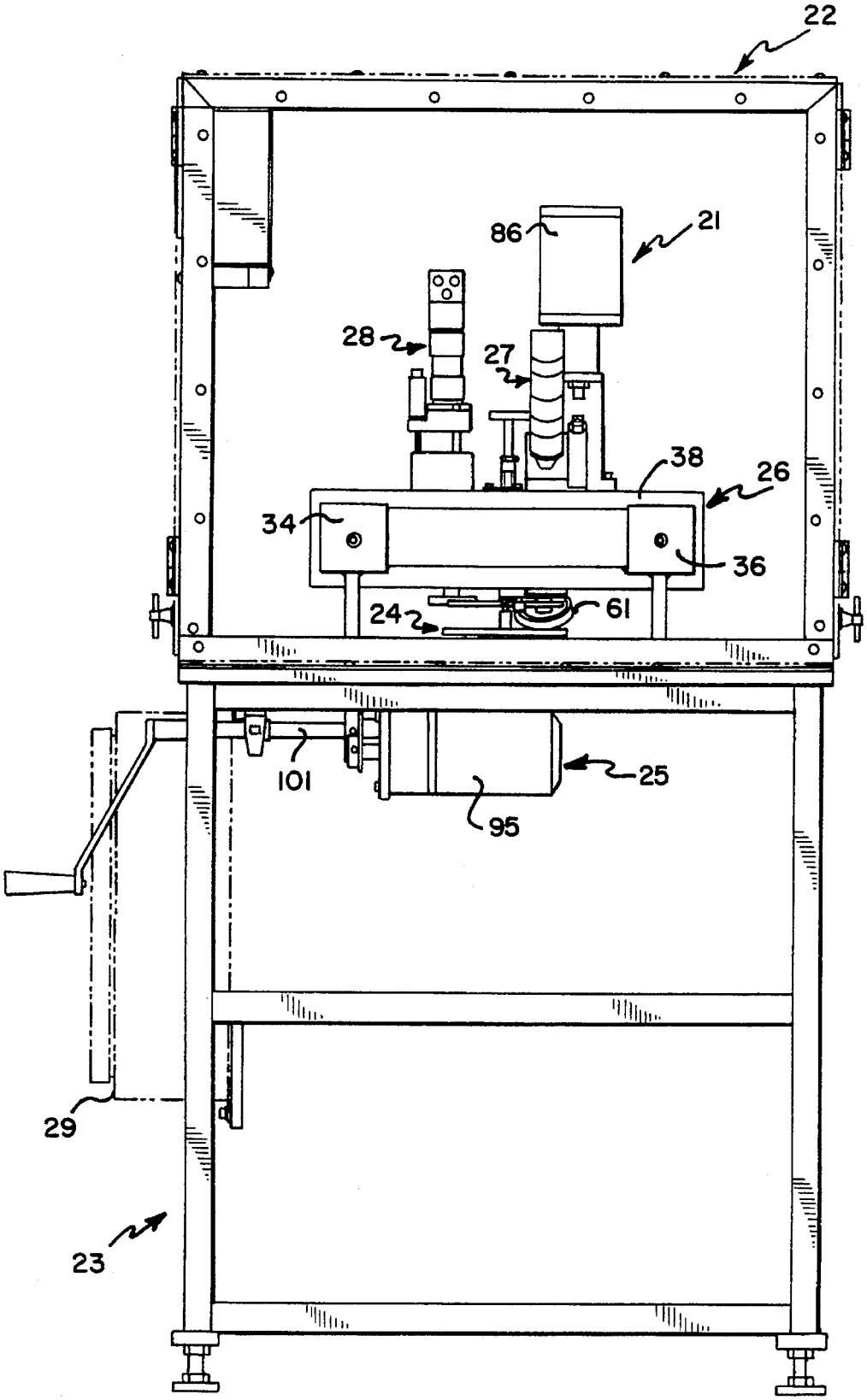
FIG. 2 is an elevational right side view of the device illustrated in FIG. 1.
Figure 3:
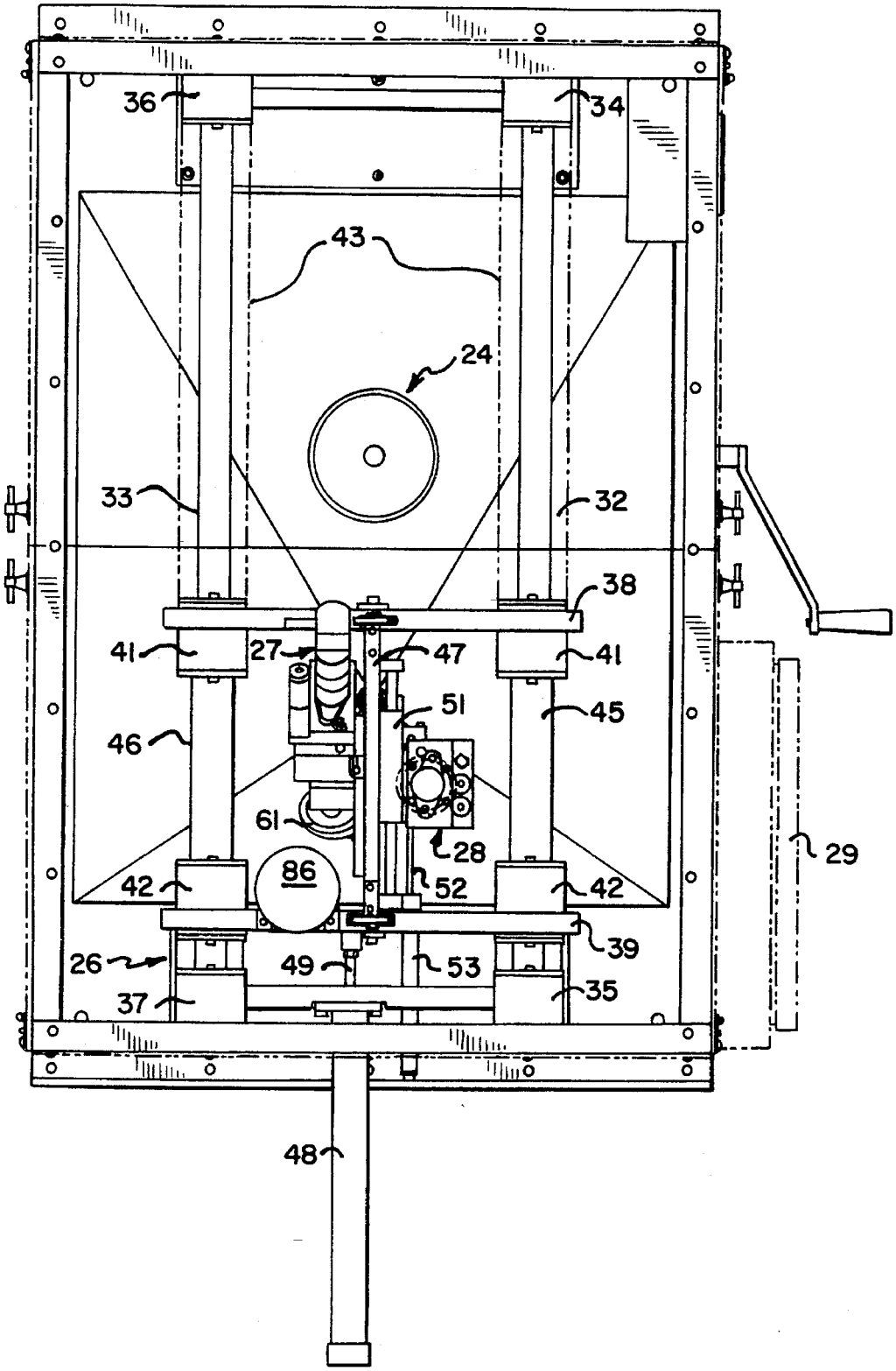
FIG. 3 is a top plan view of the illustrated apparatus.

An off-line honer, generally designated at 21 in FIG. 1, is illustrated within a shroud or closeable cabinet, generally designated at 22, resting on a suitable support structure, generally designated at 23. This overall arrangement is illustrative of other possible structures for supporting and enclosing the off-line honer assembly. The use of an enclosure cabinet 22 is useful in avoiding undesirable dissipation of honing debris, including ground particles and lubricating oil which will be prevented from leaving the cabinet during honing procedures, as desired.

A turntable assembly, generally designated at 24, is provided for supporting and rotating the blade to be honed, ground or sharpened. It is driven by a motor assembly, generally designated at 25. A carriage assembly, generally designated at 26 movably supports one or more spindle assemblies, two spindle assemblies 27 and 28 being illustrated. By suitable camming mechanisms and control arrangements, the honing component of each spindle assembly closely follows the curvature of the blade being honed, ground or sharpened while it is rotated by operation of the motor assembly. Suitable control equipment, preferably including computer hardware and software programmed to provide desired control outputs for each given style or size of cutter blade, are suitably housed in control cabinet 29. A control panel 31 allows the operator to input certain data and functions in order, for example, to select the proper program for the blade to be honed, ground or sharpened.

With further reference to the carriage assembly 26, reference is made to FIGS. 1, 2, 3 and 4. Two elongated guide pins 32, 33 are mounted to the support structure 23 by suitable supports 34, 35, 36, 37. Slide plates 38, 39 are slidably mounted onto both of the elongated guide pins 32, 33. In the illustrated embodiment, this slidability is facilitated by bearing assemblies 41, 42. Protective accordion covers or boots 43, 44 are preferably included to provide protection from honing debris for the elongated guide pins 32, 33. Rigid cylinders 45, 46 provide protection for the remainder of the elongated guide pins and structurally join the slide plates 38, 39 such as through the bearing assemblies 41, 42.

In the illustrated embodiment, the slide plates 38, 39, bearing assemblies 41, 42 and rigid cylindrical covers 45, 46 constitute components of a sliding support assembly for the spindle assemblies 27, 28, by virtue of which the spindle assemblies will move, as required by the camming arrangement and/or program for the particular blade being honed, ground or sharpened. The illustrated sliding support assembly includes a support bar 47 (FIG. 3) secured between the slide plates 38, 39 and to which the spindle assemblies 27, 28 are mounted. A two-way fluid cylinder 28 affects movement of the sliding support assembly. In the illustrated embodiment, its rod 49 is secured to the slide plate 39.

With this arrangement of the illustrated sliding support assembly, it will be noted that this assembly will move as a unit and will be responsive to the urgings of the cylinder 48. In order to provide for additional adjustability and added precision, one or more of the spindle assemblies can include a subsidiary adjustment mechanism. In the illustrated embodiment, one of the spindle assemblies 28 includes an independent mounting arrangement to allow this spindle assembly to slide without causing sliding of the other spindle assembly 27. Included in this regard is a slidable mount 51 for the spindle assembly 28. The rod 52 of another two-way fluid cylinder 53 is provided in order to allow and/or effect sliding movement of the spindle assembly 28. In the illustrated embodiment, two-way fluid cylinder 48 is substantially larger in stroke than is the two-way fluid cylinder 53. For example, cylinder 48 can have a fourteen inch stroke, while cylinder 53 can have a six inch stroke.

Referring now in greater detail to the honing spindle assemblies, the illustrated embodiment includes two such assemblies. Assembly 27 is shown in the drawings for honing or grinding the primary angle bottom width of the cutting edge of the blade, while the assembly 28 is shown for honing or grinding the top land width of the blade. In the illustrated arrangement, spindle assembly 27 is shown honing or grinding a primary angle on the so-called bottom surface of the peripheral cutting edge of a blade 54, and spindle assembly 28 is shown honing or grinding a so-called top flat land width of the peripheral cutting edge of the blade 54. This is perhaps best shown in FIGS. 4, 5, 13 and 14.

Figure 4:
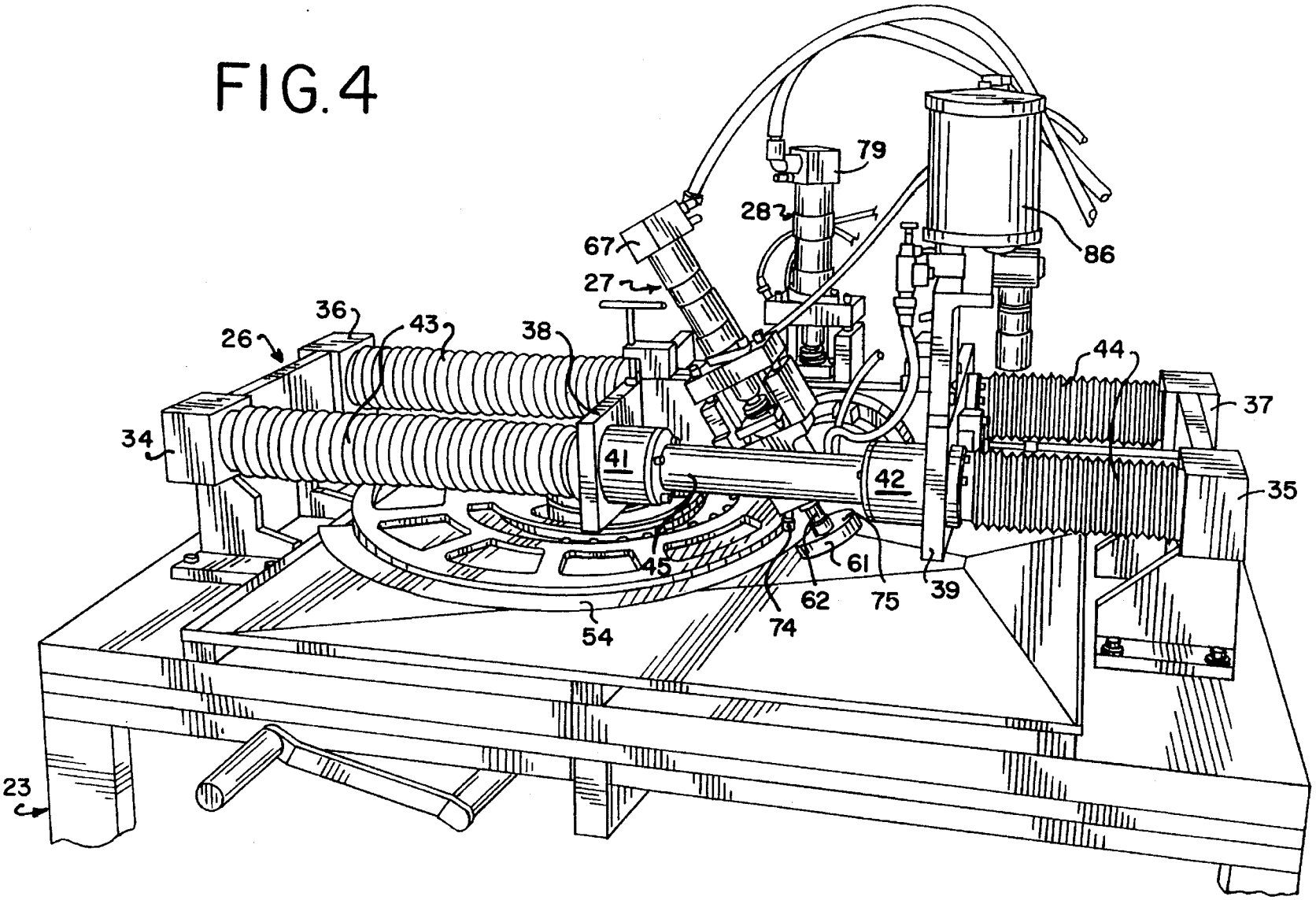
FIG. 4 is a perspective view of the illustrated apparatus.
Figure 5:
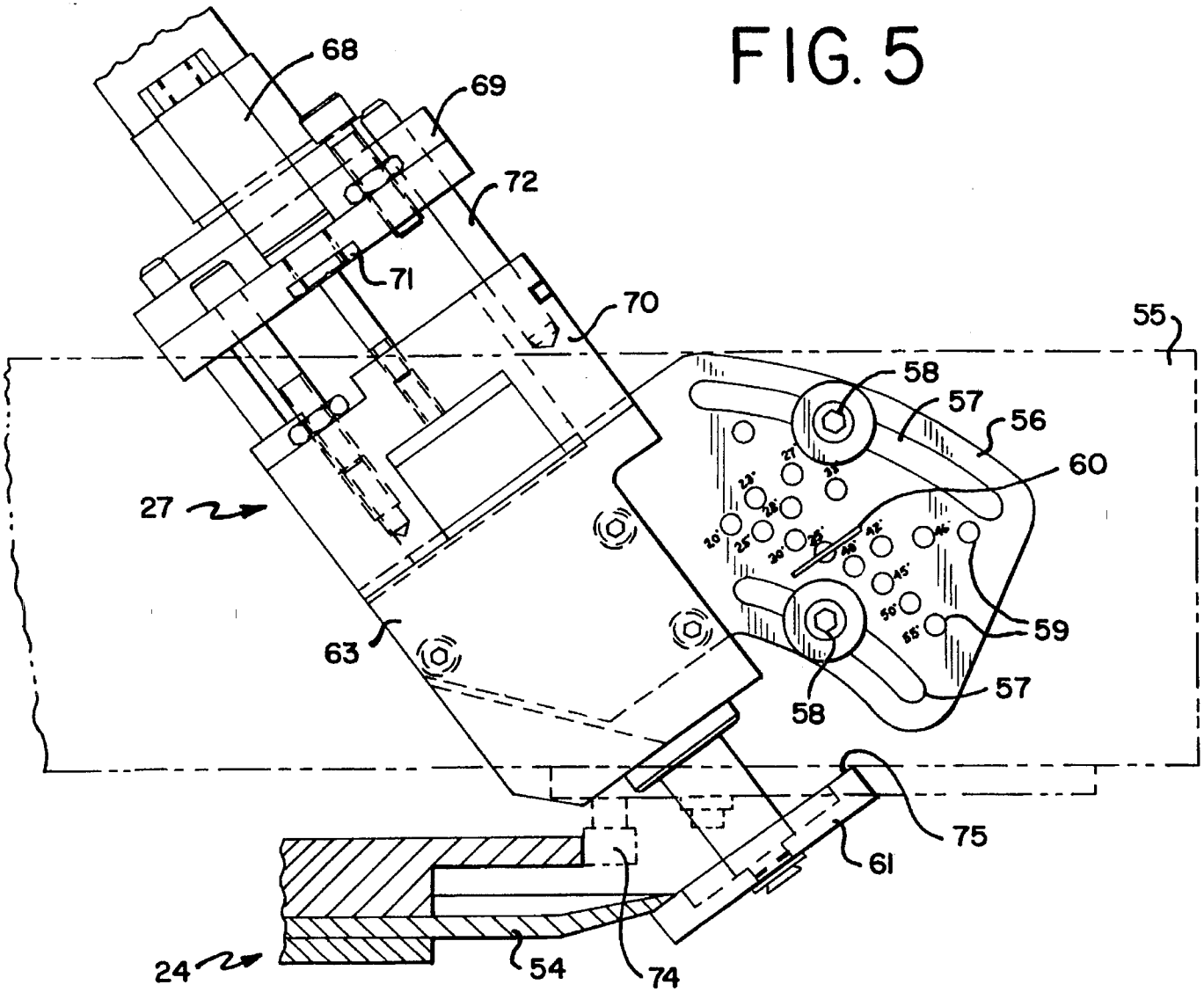
FIG. 5 is an elevational view of a honing spindle assembly of the illustrated apparatus, including a partial view, in cross-section, of the cam and blade holding assembly associated therewith.
Figure 6:
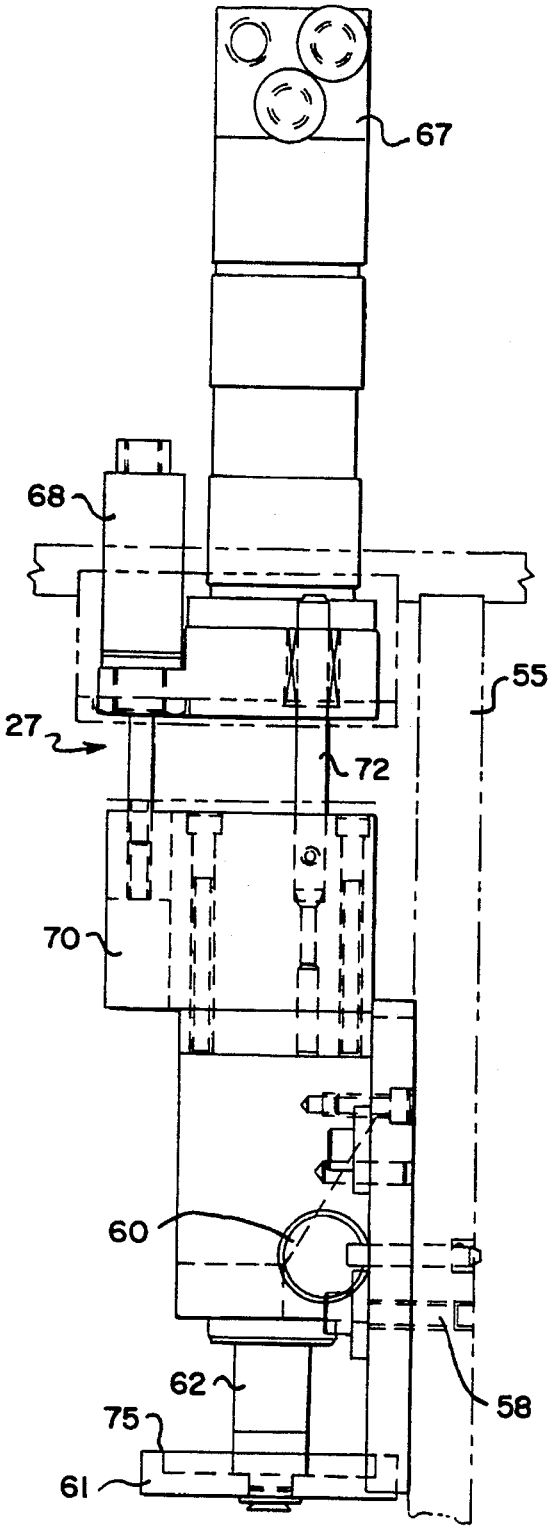
FIG. 6 is a side elevational view of the spindle assembly shown in FIG. 5.

Further details of the primary angle spindle assembly 27 are found in FIGS. 4, 5, 6 and 7. A mounting plate 55 or any other suitable arrangement is secured to the sliding support assembly, and the primary angle spindle assembly 27 is secured thereto in an adjustable manner whereby the primary angle honing angle can be varied in accordance with the needs of the particular blade being honed or ground. In this regard, a pivot plate 56 is provided. Included are one or more slots 57 through which tightening bolts 58 pass. The rest of the spindle assembly 27 is rigidly secured to the pivot plate 56. A plurality of marked angle indicator holes 59 are preferably provided in order to designate primary angle values without having to independently measure same during each adjustment of the primary angle which is imparted to the blade 54 by the primary angle spindle assembly 27. For example, FIG. 5 shows the primary angle set at 35° by a pull ring 60.

In addition to this angular adjustment, the illustrated spindle assemblies permit axial extension and retraction of the honing member itself. More specifically, each spindle assembly includes a honing or grinding wheel 61 which is suitably mounted to a spindle 62 rotatably mounted within a housing 63 through the use of suitable bearings 64. The illustrated seals 65, bushings and spacers are associated with spindle mounting member 66 in order to ensure true and low-friction axial rotation of the honing member 61. This rotation is imparted by a suitable arrangement such as the illustrated motor 67.

Figure 7:
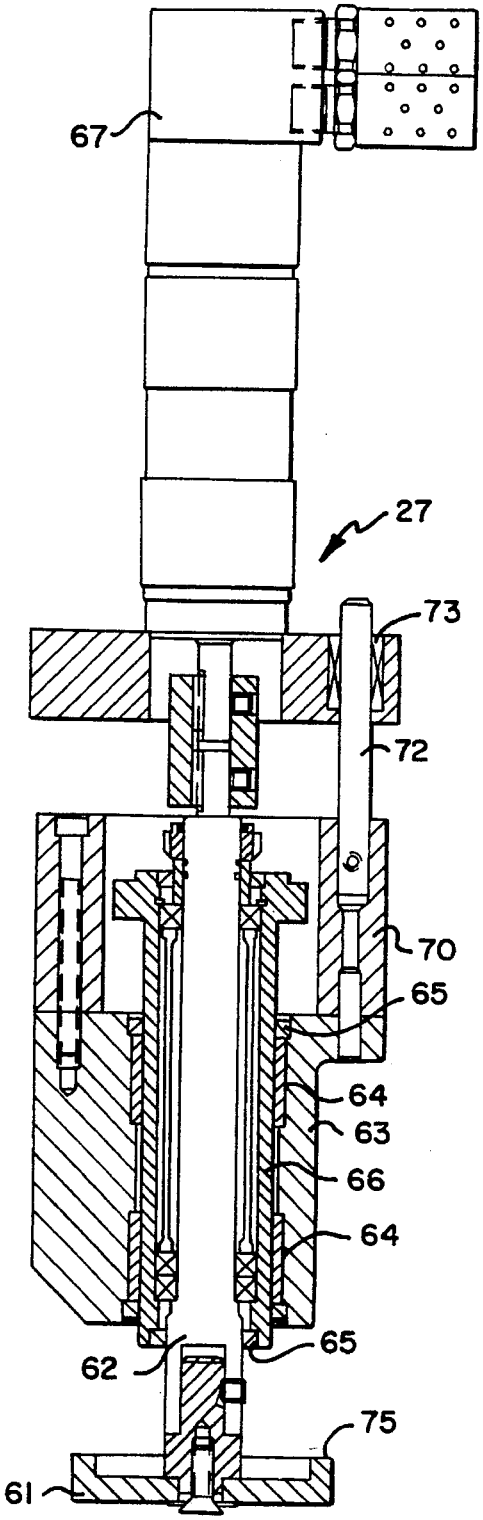
FIG. 7 is a view, primarily in cross-section, of the assembly as shown in FIG. 5.

Movement of the spindle 62 within the housing 63 is effected by an air cylinder 68, a suitable air cylinder in this regarding having a one inch stroke. Air cylinder 68 is secured to a motor adaptor plate 69 through the use, for example, of a cylinder mounting nut 71 and with the guidance of a spindle guide rod 72, which can be mounted to a spindle riser 70 and within a suitable bearing 73 as illustrated (FIG. 7). Retraction of the rod of the air cylinder 68 will cause the honing member or wheel 61 to move generally outwardly or inwardly, while extension thereof will cause the honing member or wheel to move generally downwardly or outwardly. As discussed in greater detail herein, a cam follower 74 is in operative securement with the spindle assembly 27 and thus with the working face 75 of the honing or grinding wheel 61.

Figure 8:
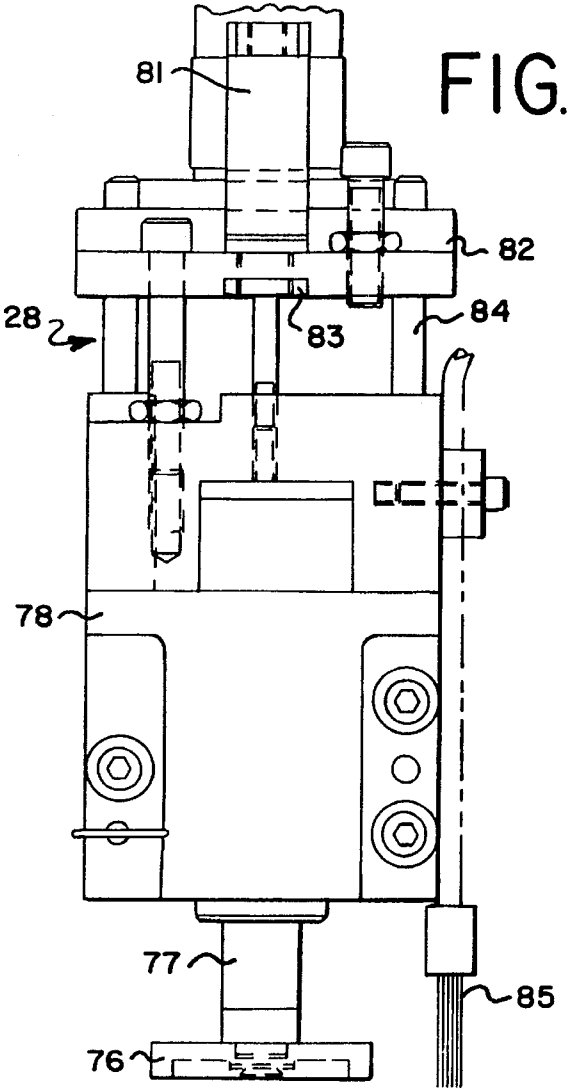
FIG. 8 is an elevational view of another honing spindle assembly of the illustrated off-line honing apparatus.

FIG. 8 provides further details of the spindle assembly 28 as it is illustrated in the drawings as a deburring spindle assembly. This particular assembly omits the angle adjustment assembly of the spindle assembly 27. It is shown as being mounted in a substantially vertical manner in order to hone, grind or sharpen a flat top portion or top flat land width of the blade 54. It also includes other components of the spindle assembly 27 including a honing or grinding wheel 76, a spindle 77, a housing 78, an air motor 79, an air cylinder 81, a motor adaptor plate 82, a cylinder mounting nut 83, and at least one spindle guide rod 84. In addition, a lubricating brush 85 is shown in association with this spindle assembly in order to provide a stream of lubricating oil or cutting oil which can be conveniently stored in a reservoir 86 (FIG. 4). Preferably this provides for honing or grinding within an oil bath which can be recycled as desired.

FIGS. 9, 10, 11 and 12 illustrate the turntable assembly 24. A turntable spindle 87 is rotatably mounted within a sleeve 88 secured to a horizontal member 89 of the support structure 23. A table top or turntable 91 is secured to the spindle 87. Depending upon the particular blade being honed or ground, a mounting bolt 92 will directly secure a plate clamp 93 (FIGS. 11, 12 and 15) or a cam 94 (FIGS. 9 and 10) to rotate with the spindle 87. When the plate clamp approach is used, it clamps down the cam to hold the blade securely and flatly.

Figure 15:
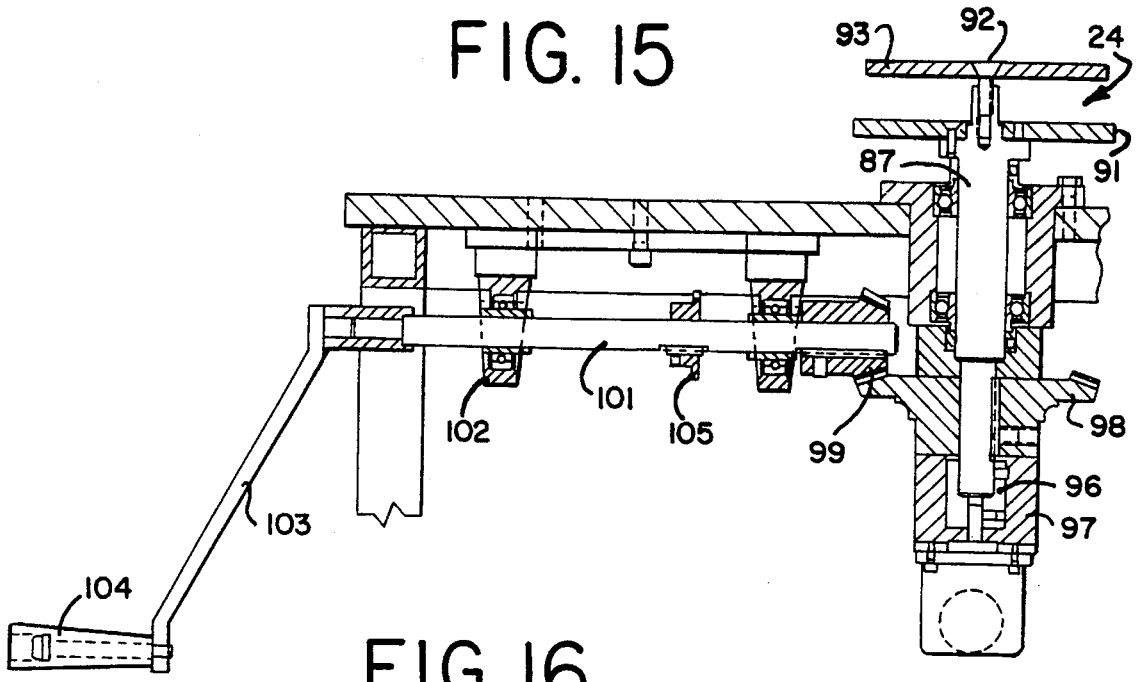
FIG. 15 is a cross-sectional view illustrating a manual arrangement for facilitating alignment of the cam and blade assembly.

Spindle 87 and thus the turntable assembly 24 is driven by a suitable motor 94 (FIG. 1) during the honing or grinding procedure. In this regard, an encoder 96 and an encoder mounting bracket 97 (FIG. 15) are provided. Also shown in FIG. 15 is a manual crank arrangement whereby a proper starting point for the honing or grinding operation can be manually located. Included is a bevel gear 98 and an associated bevel pinion 99. Drive shaft 101 is shown mounted within a pillow block 102, and a crank 103 and handle 104 are mounted for driving engagement with the drive shaft 101 as desired. Motor 95 will rotate the drive shaft through a suitable drive arrangement including sprocket 105.

Figure 10:
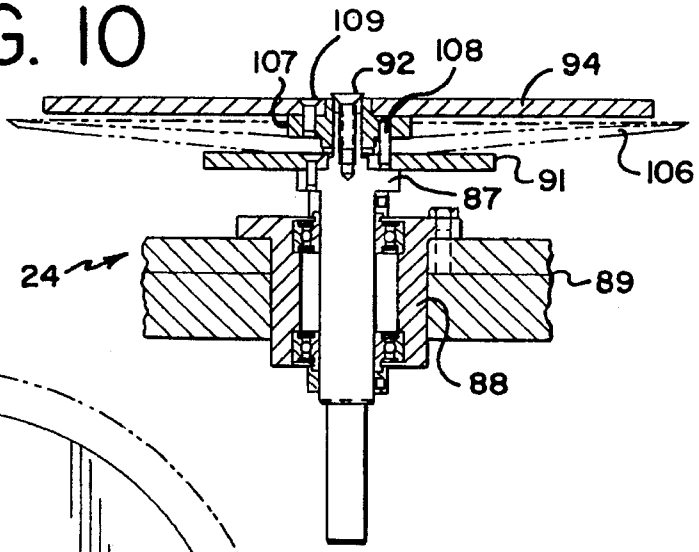
FIG. 10 is a partial cross-sectional view along the line 10—10 of FIG. 9.
Figure 9:
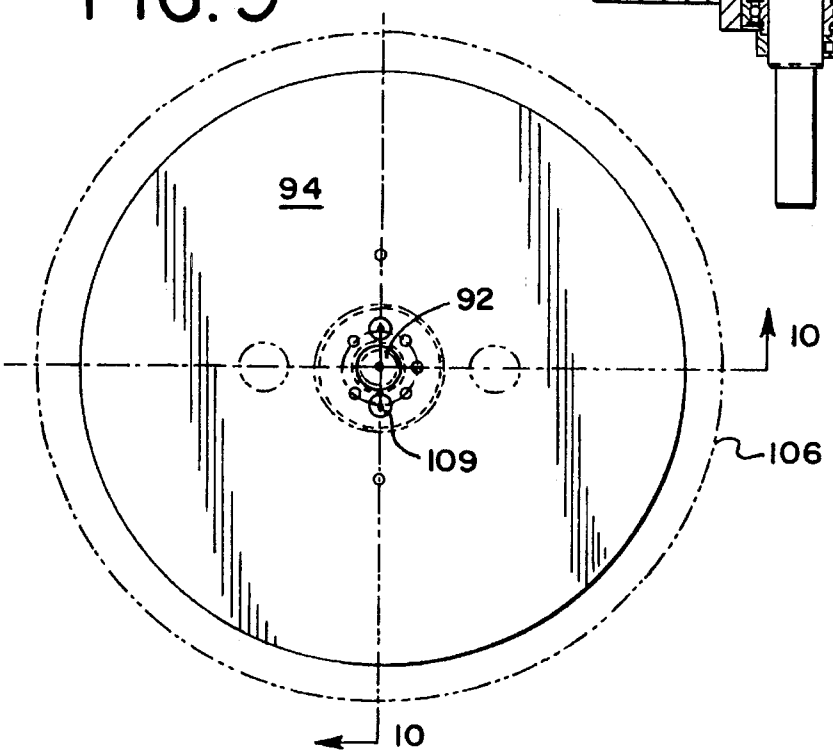
FIG. 9 is a top plan view of a cam and blade mounting assembly for a circular blade, the blade being illustrated in phantom.

FIGS. 9 and 10 illustrate an arrangement wherein a circular blade 106 is to be handled in accordance with the present invention. The blade is placed upon the turntable 91. A cam pilot 107 is positioned between this blade and the circular cam 94 that is of the proper size for blade 106. Assembly preferably includes the use of one or more dowels 108 and screws 109.

Figure 11:
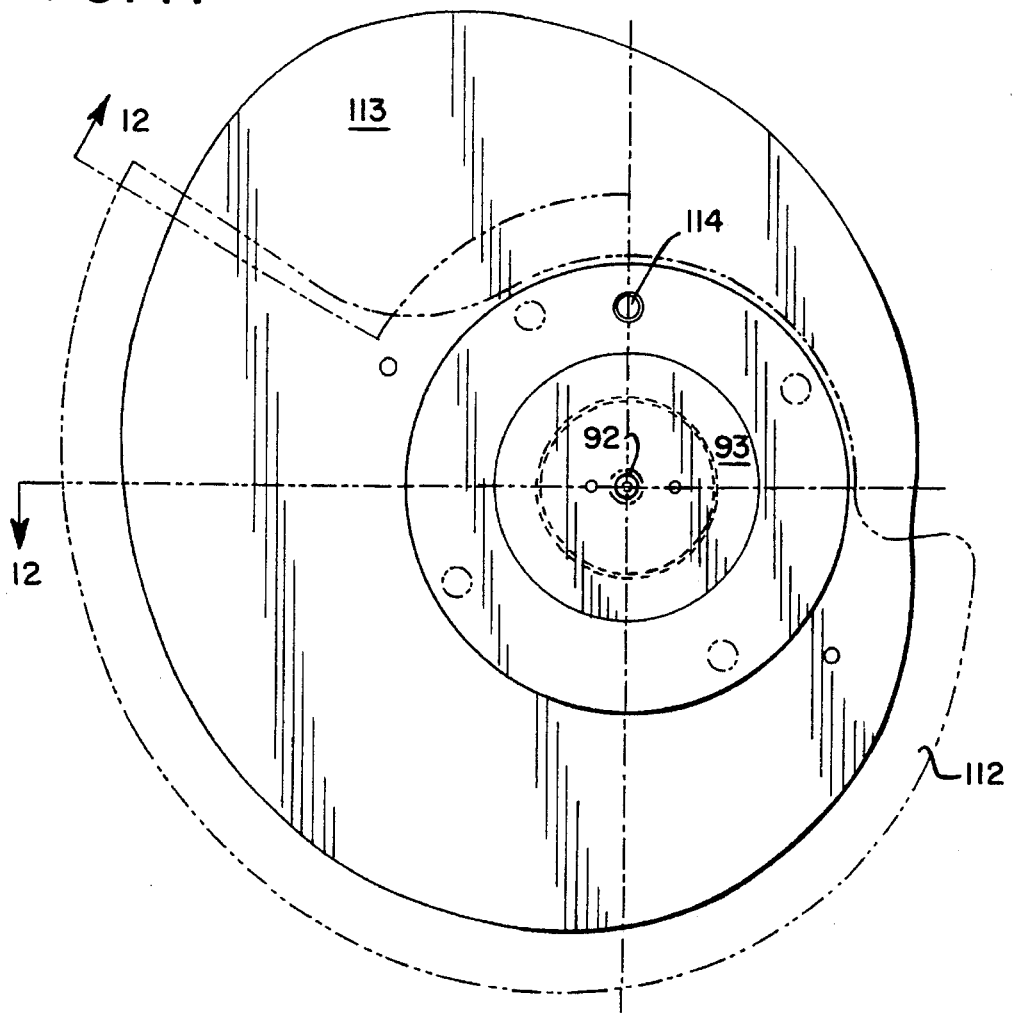
FIG. 11 is a top plan view of a cam and blade mounting assembly for a blade having an involute cutting peripheral edge, the blade being shown in phantom.
Figure 12:
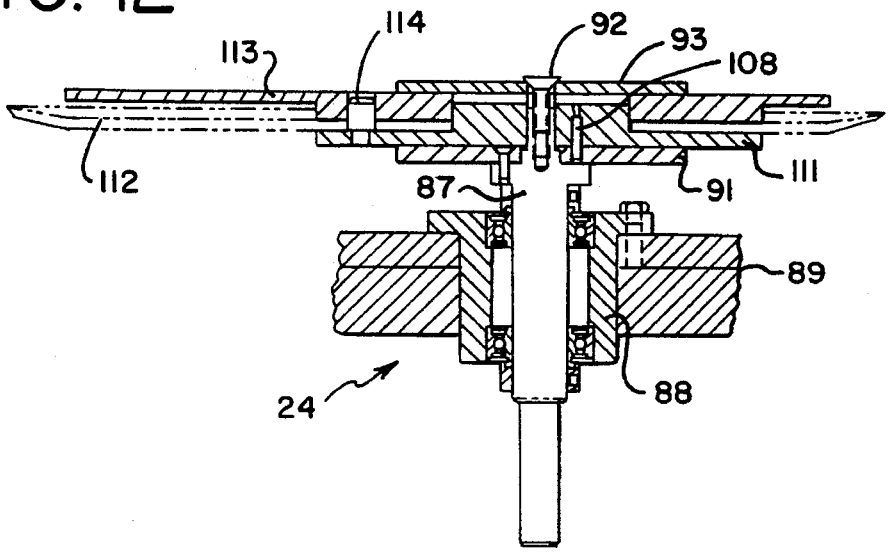
FIG. 12 is a partial cross-sectional view along the line 12—12 of FIG. 11.

FIGS. 11 and 12 illustrate a suitable arrangement for mounting a blade which has a relatively wide mounting opening and has a peripheral cutting surface that is of a generally involute shape. A spacer plate 111 is secured to the turntable 91, such as by the use of a dowel 108. The involute blade 112 is sandwiched between this spacer plate 111 and an involute cam 113 in association with the plate clamp 93 and one or more drive pins 114. It will be noted that this large involute blade and especially its generally concave body is closely secured between the surfaces of the spacer plate 111 and of the involute cam 113 in order to thereby securely hold the blade to maintain flatness of the blade. Particularly important to this desired flatness is having each cutting edge of the blade lie substantially parallel to a given plane or angled surface in order to thereby effect a honing or grinding that is flat and of uniform width along the length of the involute cutting edge.

Figure 13:
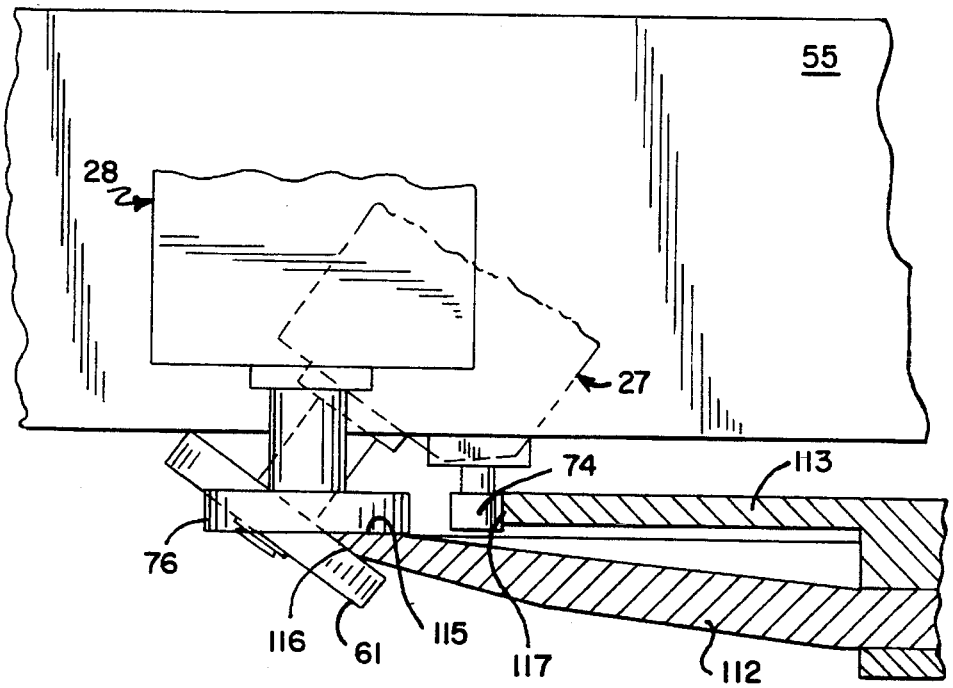
FIG. 13 is a generally schematic view, partially in cross-section, showing interaction of the cam and cam followers and the corresponding interaction of the honing wheels and blade edges being honed or ground.
Figure 14:
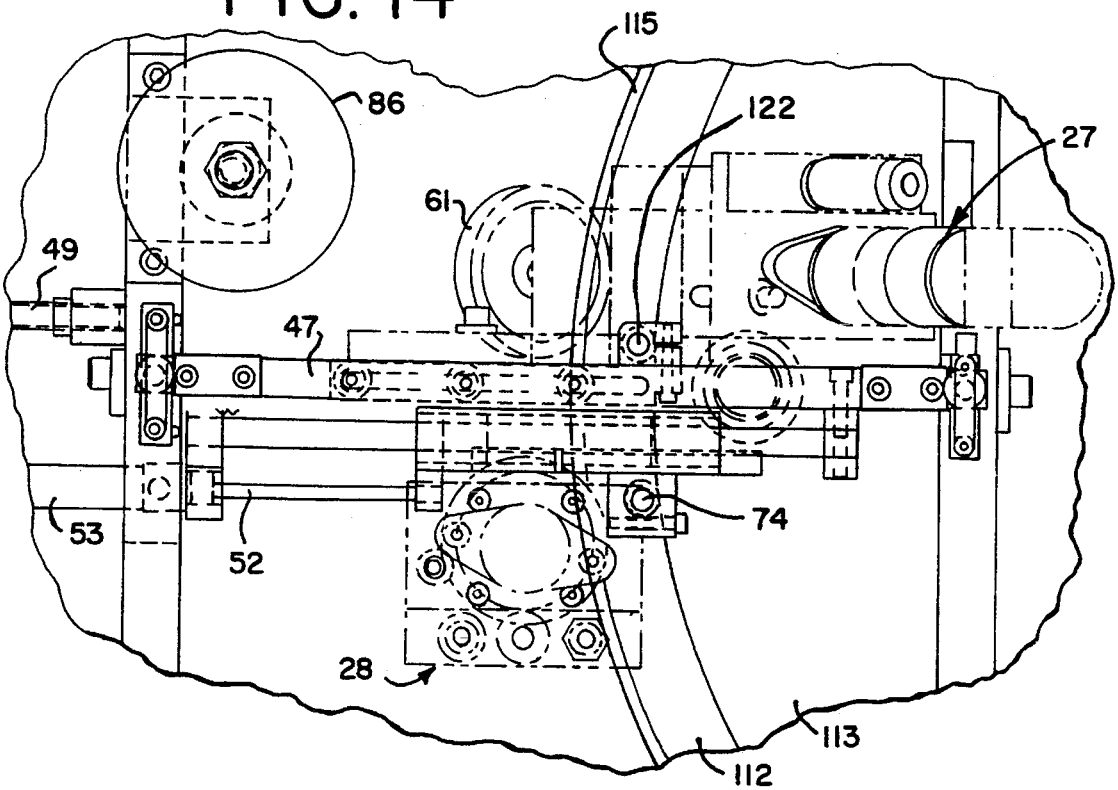
FIG. 14 is detail top plan view further illustrating the relationships depicted in FIG. 13.

FIGS. 13 and 14 provide further details of the relationship between the cam and cam follower(s) and between the honing wheel(s) and the peripheral edges of the blade being honed or ground. Illustrated blade 112 has a flat top surface or land width 115 which is engaged by the honing or grinding wheel 76. At about the same time, typically shortly therebefore, the honing or grinding wheel 61 engages the primary bevel surface 116 of the blade 112. Virtually all of any burr formation made in connection with honing of the primary bevel surface will be removed during honing of the top flat surface 115. The primary angle is the angle defined between the top flat surface 115 and the primary bevel surface 116. It will be appreciated that cam follower 74 and cam follower 122 engage and rotate along a cam surface 117 of the cam 113; of course, this illustrated cam surface 117 is curved in that it has a curved profile in the horizontal orientation as shown in the drawings.

A two-way valve as previously identified biases the cam followers 74 and 122 onto the cam surface 117. This biassing action will include, at least in the case of a non-circular blade, both extension and retraction of the cylinder rod 49. The extension is due primarily to the hydraulic pressure imparted by the cylinder rod by the two-way fluid cylinder 48, and the retraction is due primarily to the overcoming of that hydraulic pressure when the profile of the cam surface so dictates, such as when it is in a mode of increasing radius length.

Figure 16:
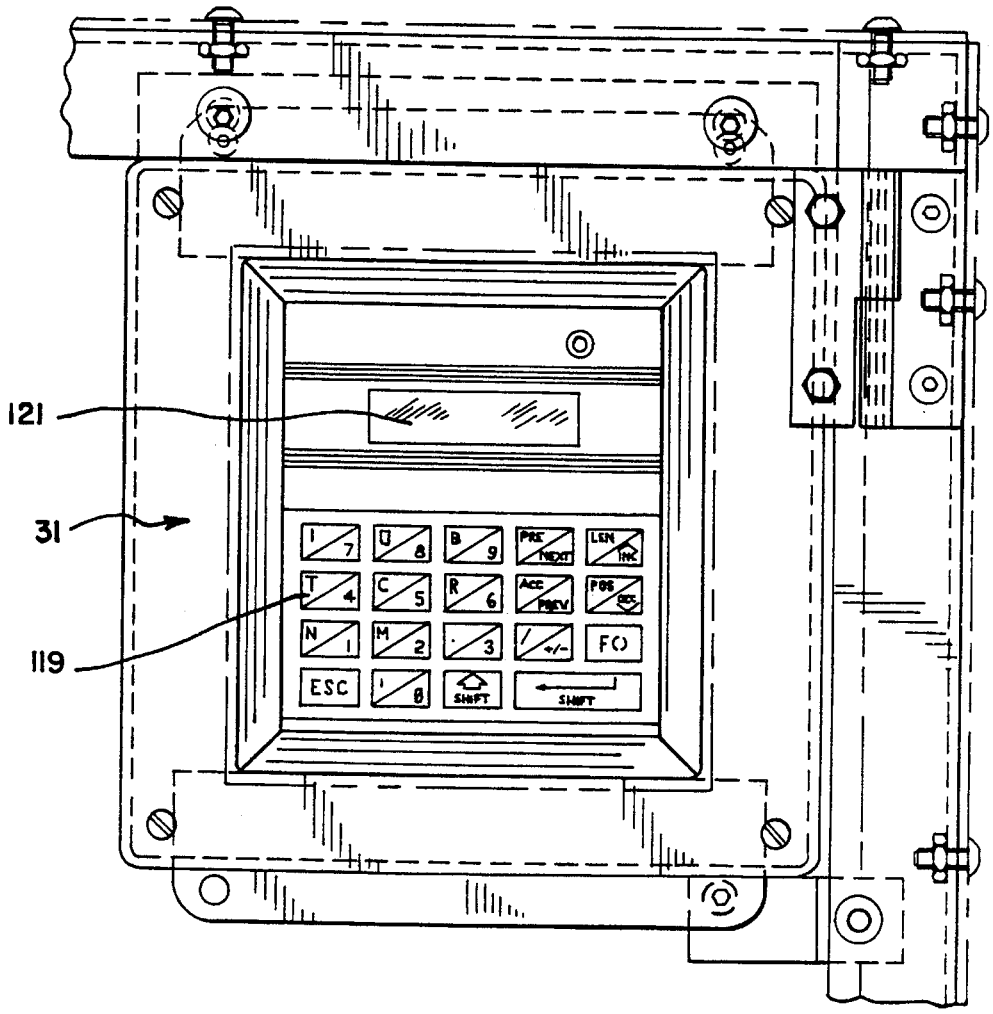
FIG. 16 is an enlarged view of a typical control panel for the FIG. 1 apparatus.

FIG. 16 illustrates a typical control panel and display which can be provided for controlling and monitoring the rotation of the turntable assembly 24 and the extension and retraction of the two-way fluid cylinders 48 and/or 53 and of the air cylinders 68 and 81. Control panel 31 includes a plurality of control keys 119, as well as a display 121. By activating one or more of the keys 119, the operator selects one of the pre-programmed control patterns that had been previously entered into memory. For example, the operator could enter a proper code for the particular type of blade being honed, ground or sharpened. In a typical application, the operator will also "zero" the blade to the designated starting point for the program. This can be achieved, for example, by turning the handle 104 and thus the turntable assembly 24 until the blade is at the designated starting point. This can be signalled, for example, by the lighting of a light or by a prompt on the display 121 or the like.

Thereafter, the program, in conjunction with the engagement between the cam follower(s) and cam when appropriate, controls movement of the honing wheel(s). This movement includes following the profile of all or substantially all of the cutting surface of the blade being honed or ground. In the case of non-circular blades, this movement also will typically include axial extension and retraction of the rotating honing wheel(s) so as to "dock" and "undock" the grinding wheels from the cutting edge being honed or ground.

For example, with particular reference to FIG. 13, the honing wheel 76 of the deburring spindle assembly 28 retracts axially to move out of engagement with the top flat surface 115 at about the same time that the surface 115 ends on a typical involute blade. Conversely, axial extension occurs in order to dock the wheel 76 onto the top flat surface 115 at or substantially at the beginning of the surface on a typical involute blade. For the primary angle spindle assembly 27, reverse movements will generally be required in order to dock and undock.

A typical manner by which the rotation position of the blade can be tracked is through the use of a pulse generator in connection with the motor 95. For example, the command to dock the honing wheel(s) can occur after a given number of generated pulses beyond the zero setting, and the honing wheel(s) will be undocked after an additional given number of pulses have been generated. The appropriate number of pulses in each instance will be determined according to the pre-programmed specifics for each type of slicer blade.

It will be understood that the embodiments of the present invention which have been described are illustrative of some of the applications of the principles of the present invention. Various modifications may be made by those skilled in the art without departing from the true spirit and scope of the invention.

We claim:

1. A method for honing or grinding a slicer blade having a curved cutting surface, comprising the steps of:

removing a slicer blade having a curved cutting surface from a food slicer, and transporting same to a honing apparatus at an off-line location;

securing the slicer blade in association with a cam member such that at least a substantial portion of a curved pathway camming surface of the cam member follows the curved cutting surface of the slicer blade at a location spaced inwardly of the curved cutting surface of the slicer blade;

engaging the curved cutting surface of the slicer blade with a honing or grinding member, wherein said engaging step includes engaging a top portion of the curved cutting surface of the slicer blade with one honing or grinding member while also engaging a bottom portion of the curved cutting surface of the slicer blade with another honing or grinding member;

rotating the slicer blade and the cam member together while a cam follower engages and follows the cam member, including controlling the position of the honing or grinding members by moving the cam follower along the cam member; and said engaging and rotating steps combine to hone or grind both the top portion and the bottom portion of the curved cutting surface of the slicer blade.

2. The method in accordance with claim 1, wherein the engaging of the top portion is at an angle generally parallel to the blade and the engaging of the bottom portion is at an acute angle with respect to the blade.

3. The method in accordance with claim 2, wherein the engaging of the top portion and the engaging of the bottom portion are carried out at locations closely spaced from one another.

4. A method for honing or grinding a slicer blade having a curved cutting surface, comprising the steps of:

removing a slicer blade having a curved cutting surface from a food slicer, and transporting same to a honing apparatus at an off-line location;

securing the slicer blade in association with a cam member such that at least a substantial portion of a curved pathway camming surface of the cam member follows the curved cutting surface of the slicer blade at a location spaced inwardly of the curved cutting surface of the slicer blade;

engaging the curved cutting surface of the slicer blade with a honing or grinding member;

rotating the slicer blade and the cam member together while a cam follower engages and follows the cam member, including controlling the position of the honing or grinding wheel by moving the cam follower along the cam member wherein said controlling of the position of the honing or grinding wheel includes biasing the cam follower into following engagement with the cam member; and said engaging and rotating steps combine to hone or grind the curved cutting surface of the slicer blade.

5. A honing apparatus for a slicer blade having a curved cutting surface, comprising:

a cam member having a curved pathway camming surface, at least a substantial portion of which has a shape that is substantially the same as the shape of a curved cutting surface of a preselected slicer blade and has a radial extent that is less than the radial extent of a corresponding location along the curved cutting surface of the preselected slicer blade;

a rotation assembly which rotates said cam member and its corresponding preselected slicer blade together;

a honing spindle assembly having a rotatable honing member and a cam follower operatively connected together such that said rotatable honing member moves in response to movement of said cam follower, and said cam follower engages and follows movement of said curved pathway surface of the cam member in response to said rotation assembly, and said rotatable honing member thereby follows and engages a peripheral edge of said curved cutting surface of the preselected slicer blade while said honing member is rotating; and a carriage assembly, said honing spindle assembly being mounted to said carriage assembly such that said honing spindle assembly is slidable toward and away from said cam member along a direction generally parallel to said cam member.

6. The honing apparatus in accordance with claim 1, further including a mounting member rotatable by said rotation assembly, said mounting member being for mounting the preselected slicer blade having a curved cutting surface to be honed or ground by the honing apparatus.

7. The honing apparatus in accordance with claim 6, wherein said mounting assembly includes a cam pilot.

8. The honing apparatus in accordance with claim 6, wherein said mounting assembly includes a pair of generally opposing plates between which said cam member and said cutter blade are securely mounted.

9. The honing apparatus in accordance with claim 1, further including at least two of said honing spindle assemblies, one honing spindle assembly being a bevel surface spindle assembly which has a honing surface that defines an acute angle with respect to the peripheral edge of the curved cutting surface of the slicer blade.

10. The honing apparatus in accordance with claim 9, wherein another of said honing spindle assemblies has its rotatable honing member with a honing surface that is substantially parallel to a flat peripheral cutting surface of the slicer blade.

11. A honing apparatus for a slicer blade having a curved cutting surface, comprising:

a cam member having a curved pathway camming surface, at least a substantial portion of which has a shape that is substantially the same as the shape of a curved cutting surface of a preselected slicer blade and has a radial extent that is less than the radial extent of a corresponding location along the curved cutting surface of the preselected slicer blade;

a rotation assembly which rotates said cam member and its corresponding preselected slicer blade together;

at least two honing spindle assemblies, each having a rotatable honing member and a cam follower operatively connected together such that said rotatable honing member moves in response to movement of said cam follower, and said cam follower engages and follows movement of said curved pathway surface of the cam member in response to said rotation assembly, and said rotatable honing member thereby follows and engages a peripheral edge of said curved cutting surface of the preselected slicer blade while said honing member is rotating; and one said spindle assembly is a primary angle assembly to hone or grind a primary angle along the peripheral cutting edge of the slicer blade, and the other of said honing spindle assemblies is a deburring spindle assembly which generally defines a flat top land width of the slicer blade.

12. A honing apparatus for a slicer blade having a curved cutting surface, comprising:

a cam member having a curved pathway camming surface, at least a substantial portion of which has a shape that is substantially the same as the shape of a curved cutting surface of a preselected slicer blade and has a radial extent that is less than the radial extent of a corresponding location along the curved cutting surface of the preselected slicer blade;

a rotation assembly which rotates said cam member and its corresponding preselected slicer blade together;

a honing spindle assembly having a rotatable honing member and a cam follower operatively connected together such that said rotatable honing member moves in response to movement of said cam follower, and said cam follower engages and follows movement of said curved pathway surface of the cam member in response to said rotation assembly, and said rotatable honing member thereby follows and engages a peripheral edge of said curved cutting surface of the preselected slicer blade while said honing member is rotating; and a biasing assembly by which said cam follower is urged into engagement with said cam member, said biasing assembly allowing for movement of said cam member in opposition to said biasing assembly.

13. The honing apparatus in accordance with claim 12, wherein said biasing assembly includes a sliding support assembly with respect to which said honing spindle assembly is slidably mounted, said biasing assembly further including a fluid cylinder that extends and retracts to maintain the cam follower in camming engagement with said cam member.

14. A honing apparatus for a slicer blade having a curved cutting surface, comprising:

a cam member having a curved pathway camming surface, at least a substantial portion of which has a shape that is substantially the same as the shape of a curved cutting surface of a preselected slicer blade and has a radial extent that is less than the radial extent of a corresponding location along the curved cutting surface of the preselected slicer blade;

a rotation assembly which rotates said cam member and its corresponding preselected slicer blade together;

a honing spindle assembly having a rotatable honing member and a cam follower operatively connected together such that said rotatable honing member moves in response to movement of said cam follower, and said cam follower engages and follows movement of said curved pathway surface of the cam member in response to said rotation assembly, and said rotatable honing member thereby follows and engages a peripheral edge of said curved cutting surface of the preselected slicer blade while said honing member is rotating; and said honing spindle assembly includes a movement assembly by which said rotatable honing member moves into and out of engagement with said curved cutting surface at selected locations along the slicer blade.

15. The honing apparatus in accordance with claim 14, wherein said movement assembly includes a two-way fluid cylinder.

16. The honing apparatus in accordance with claim 14, wherein said movement assembly is associated with a control assembly that is pre-programmed to axially extend and retract said rotatable honing member during relative movement between said cam member and said honing spindle assembly.

17. A honing apparatus for a slicer blade having a curved cutting surface, comprising:

a cam member having a curved pathway camming surface, at least a substantial portion of which has a shape that is substantially the same as the shape of a curved cutting surface of a preselected slicer blade and has a radial extent that is less than the radial extent of a corresponding location along the curved cutting surface of the preselected slicer blade;

a rotation assembly which rotates said cam member and its corresponding preselected slicer blade together;

a honing spindle assembly having a rotatable honing member and a cam follower operatively connected together such that said rotatable honing member moves in response to movement of said cam follower, and said cam follower engages and follows movement of said curved pathway surface of the cam member in response to said rotation assembly, and said rotatable honing member thereby follows and engages a peripheral edge of said curved cutting surface of the preselected slicer blade while said honing member is rotating; and each of said curved cutting surface and said curved pathway of the camming surface are substantially circular.

18. A honing apparatus, for a slicer blade having a curved cutting surface, comprising:

a cam member having a curved pathway camming surface, at least a substantial portion of which has a shape that is substantially the same as the shape of a curved cutting surface of a preselected slicer blade and has a radial extent that is less than the radial extent of a corresponding location along the curved cutting surface of the preselected slicer blade;

a rotation assembly which rotates said cam member and its corresponding preselected slicer blade together;

a honing spindle assembly having a rotatable honing member and a cam follower operatively connected together such that said rotatable honing member moves in response to movement of said cam follower, and said cam follower engages and follows movement of said curved pathway surface of the cam member in response to said rotation assembly, and said rotatable honing member thereby follows and engages a peripheral edge of said curved cutting surface of the preselected slicer blade while said honing member is rotating; and each of said curved cutting surface and said curved pathway of the camming surface are substantially involute.

19. A honing apparatus for a slicer blade having a curved cutting surface, comprising:

a cam member having a curved pathway camming surface, at least a substantial portion of which has a shape that is substantially the same as the shape of a curved cutting surface of a preselected slicer blade and has a radial extent that is less than the radial extent of a corresponding location along the curved cutting surface of the preselected slicer blade;

a rotation assembly which rotates said cam member and its corresponding preselected slicer blade together;

a honing spindle assembly having a rotatable honing member and a cam follower operatively connected together such that said rotatable honing member moves in response to movement of said cam follower, and said cam follower engages and follows movement of said curved pathway surface of the cam member in response to said rotation assembly, and said rotatable honing member thereby follows and engages a peripheral edge of said curved cutting surface of the preselected slicer blade while said honing member is rotating; and further including a crank assembly for moving the rotation assembly to a designated rotation start position.

* * * * *

UNITED STATES PATENT AND TRADEMARK OFFICE

CERTIFICATE OF CORRECTION

PATENT NO. : 5,609,512

DATED : March 11, 1997

INVENTOR(S) : Terry L. Holmes, Gary R. Skaar, Larry C. Gundlach and Dennis G. Flisram It is certified that error appears in the above-indentified patent and that said Letters Patent is hereby corrected as shown below:

Col. 1, line 49, delete "provide" and insert --provides--;

Col. 5, line 55, "regarding having" should read --regard having--.
Col. 9, line 29, "with claim 1" should read --with claim 5--; line 40, "with claim 1" should read --with claim 5--.
Col. 11, line 38, "apparatus, for" should read --apparatus for--.

Signed and Sealed this

Seventh Day of April, 1998

Bruce Lehman

*Attest:*

BRUCE LEHMAN

*Attesting Officer*

*Commissioner of Patents and Trademarks*